US005275137A

United States Patent [19]

Uesugi

[11] Patent Number: 5,275,137

[45] Date of Patent: Jan. 4, 1994

[54] VALVE OPERATING SYSTEM FOR ENGINE

[75] Inventor: Tatsuya Uesugi, Higashi-Hiroshima, Japan

[73] Assignee: Mazda Motor Corporation, Hiroshima, Japan

[21] Appl. No.: 796,445

[22] Filed: Nov. 22, 1991

[30] Foreign Application Priority Data

Nov. 28, 1990 [JP] Japan ..... 2-327108

[51] Int. Cl.[5] ..... F01L 1/34

[52] U.S. Cl. ..... 123/90.16

[58] Field of Search ..... 123/90.15, 90.16, 90.17

[56] References Cited

U.S. PATENT DOCUMENTS

| | | | |
|---|---|---|---|
| 4,854,272 | 8/1989 | Konno | 123/90.17 |
| 4,995,281 | 2/1991 | Allor et al. | 123/90.44 |
| 5,009,203 | 4/1991 | Seki | 123/90.16 |
| 5,010,856 | 4/1991 | Ojala | 123/90.36 |
| 5,060,604 | 10/1991 | Seki et al. | 123/90.16 |

FOREIGN PATENT DOCUMENTS 63-147909 6/1988 Japan .

*Primary Examiner*—Noah P. Kamen

*Attorney, Agent, or Firm*—Keck, Mahin & Cate

[57] ABSTRACT

A valve operating system for an engine includes a cam shaft and first and second cams, mounted on the cam shaft, which are selectively utilized to provide different valve opening characteristics in accordance with a vehicle operating condition. A first rocker arm follows the first cam and engages a valve stem of a valve to operate the valve, and a second rocker arm follows the second cam at a position not interfering with the valve stem. A connecting device connects the first and second rocker arms so that they move together, and a control device controls the connecting means to connect the first and second rockers in accordance with the vehicle operating condition so that the valve opening characteristic is defined by a cam profile of the second cam which is larger than that of the first cam. When the first and second rocker arms are engaged with each other, the valve opening period is increased to reduce pumping loss in the engine under relatively low engine load.

26 Claims, 9 Drawing Sheets

VALVE OPERATING SYSTEM FOR ENGINE

BACKGROUND OF THE INVENTION

1. Field of the Invention

The present invention relates to a valve operating system for an engine and, more specifically, to a valve operating system for controlling the opening of an intake and/or exhaust valve in accordance with a vehicle operation parameter.

2. Description of the Related Art

As disclosed in Japanese Patent Public Disclosure (JP A) No. 63-147909, a valve operating system for an engine has been proposed which switches a cam for operating the valve and controlling a valve opening parameter or characteristic, such as the timing of valve opening and closing, valve lift and the like.

The cam for valve operation is switched in accordance with the vehicle operating parameter to change the valve opening parameter to thereby achieve proper intake and exhaust in the engine. However, such conventional valve control does not necessarily provide the proper valve opening characteristic. Furthermore, the conventional control does not allow the limit of the rotational speed of the engine to be increased.

SUMMARY OF THE INVENTION

It is, therefore, an object of the present invention to provide a valve operating system for an engine in which a proper valve opening characteristic is provided in accordance with a vehicle operating condition so that desirable output and performance can be obtained.

The above and other objects of the present invention can be accomplished by a valve operating system for an engine comprising a cam shaft, first and second cams mounted on the cam shaft for being selectively utilized to provide different valve opening parameters in accordance with a vehicle operating parameter, a first rocker arm disposed facing the first cam for engaging a valve stem of a valve to drive the valve, a second rocker arm disposed facing the second cam at a position not interfering with the valve stem, connecting means for connecting the first and second rocker arms so that they can be moved together, control means for controlling the connecting means to connect the first and second rockers in accordance with the vehicle operating parameter so that the valve opening parameter is defined by a cam profile of the second cam which is larger than a cam profile of the first cam.

In a preferred embodiment, the first rocker arm and the first cam are provided for operating a pair of intake valves or a pair of exhaust valves.

The valve operating system of the present invention is further provided with first and second rocker shafts for swinging the first and second rocker arms. The connecting means is provided with a movable pin which is preferably movable in an axial direction of the rocker shaft and takes a first position when the first and second rocker arms are engaged to reciprocate together and a second position when the first rocker arm is disengaged from the second arm to reciprocate independently, and a lever for controlling the axial movement of the movable pin to take the first and second positions.

Further, the valve operating system is provided with an actuator for controlling the movement of the lever. The actuator moves the movable pin into a first position when the actuator is actuated by introducing a negative pressure in an intake gas. On the other hand, when the negative pressure is stopped, the actuator moves the movable pin into the second position.

According to the present invention, the connecting means connects the first and second rocker arms so that the arms swing together when the engine load is low. In this case, the second cam has a larger cam profile than the first cam. Therefore, the first rocker arm is not driven by the first cam which corresponds to the first rocker arm, and is reciprocated together with the second rocker arm which is driven by the second cam. Thus, the valve opening parameter is defined by a second cam profile.

When the vehicle is in a condition other than low engine load, the control means controls the connecting means to disengage the first rocker arm from the second rocker arm. As a result, the first rocker arm and the second rocker arm are swung according to the first cam and second cam, respectively. Therefore, the valve opening characteristic is defined by the first cam profile. In this case, the inertial weight of the rocker arm is smaller than the case where the first and second rocker arms are combined to reciprocate together so that the rocker arms can easily follow a higher speed operation of the valve operating mechanism. Therefore, when the first and second rocker arms are disengaged from each other, the spring force biasing the valve can be reduced and the maximum speed limit of the valve operation can be increased.

For example, when the present invention is applied to drive an intake valve under the low engine load, such as during idling, an opening period of the valve is increased and the closing timing is delayed. Therefore, pumping loss can be reduced in comparison with the case where the first cam is utilized.

When this invention is applied to both the intake and exhaust valve operating mechanisms, the opening timing of the exhaust gas is delayed so that the overlapping period of the opening period of the valve is increased. As a result, residual uncombusted constituents are increased to improve combustion.

Further objects features, and advantages of the present invention will become apparent from the Detailed Description of Preferred Embodiment which follows, when considered together with the attached Figures.

DESCRIPTION OF THE PREFERRED EMBODIMENT

Figure 1:
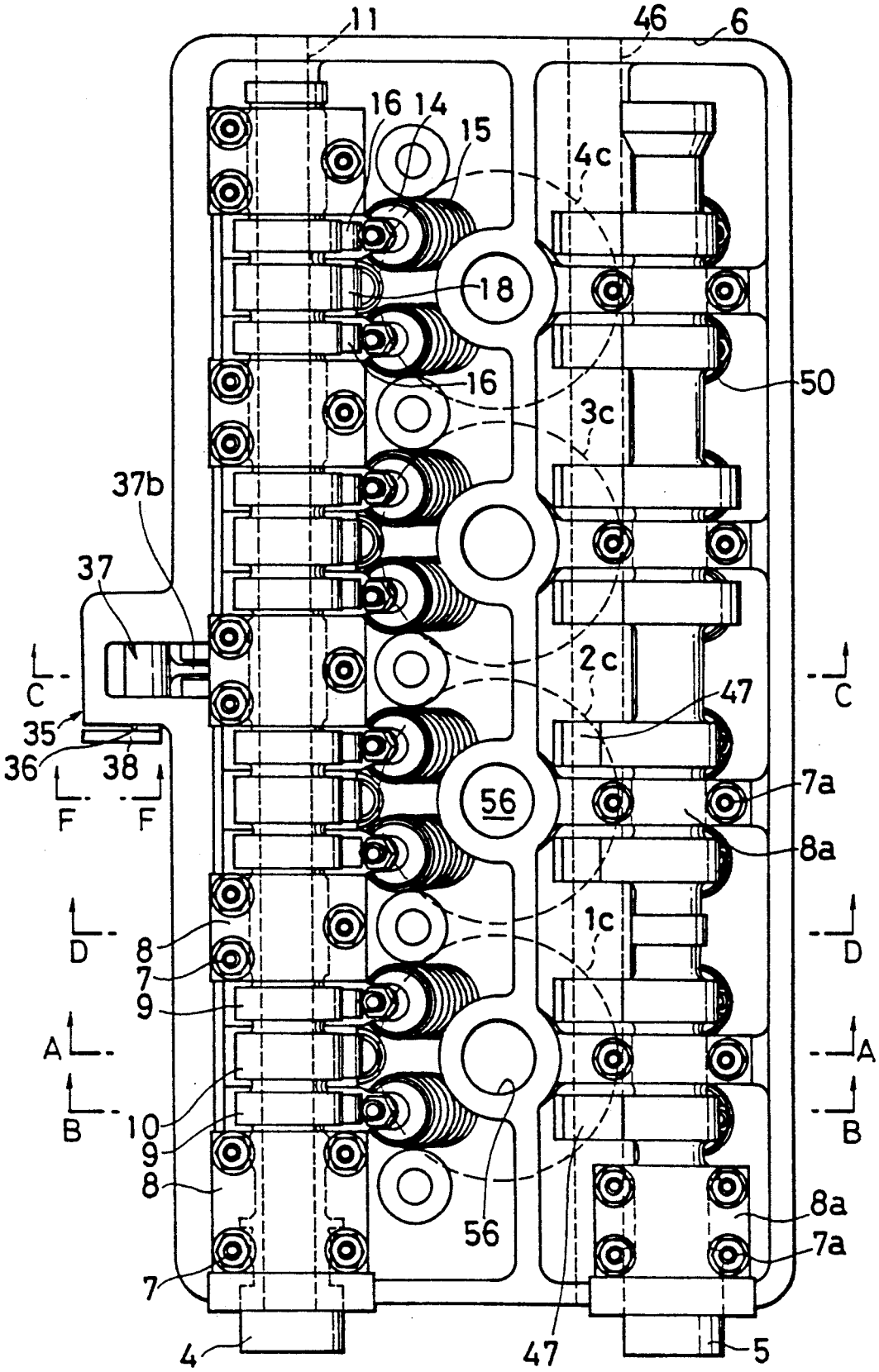
FIG. 1 is a plan view of a valve operating system to which the present invention is applied.

Hereinafter, a preferred embodiment of the present invention will be described with reference to the drawings in which like parts are represented by like reference numerals.

Referring specifically to FIG. 1, a plan view of an engine 1 is shown in which the cylinder head has been removed.

The illustrated engine is a straight four cylinder engine and is provided with a first, second, third and fourth cylinders 1C, 2C, 3C and 4C.

Each of the cylinders is provided with a pair of intake valves 2 and a pair of exhaust valves 3.

Figure 2:
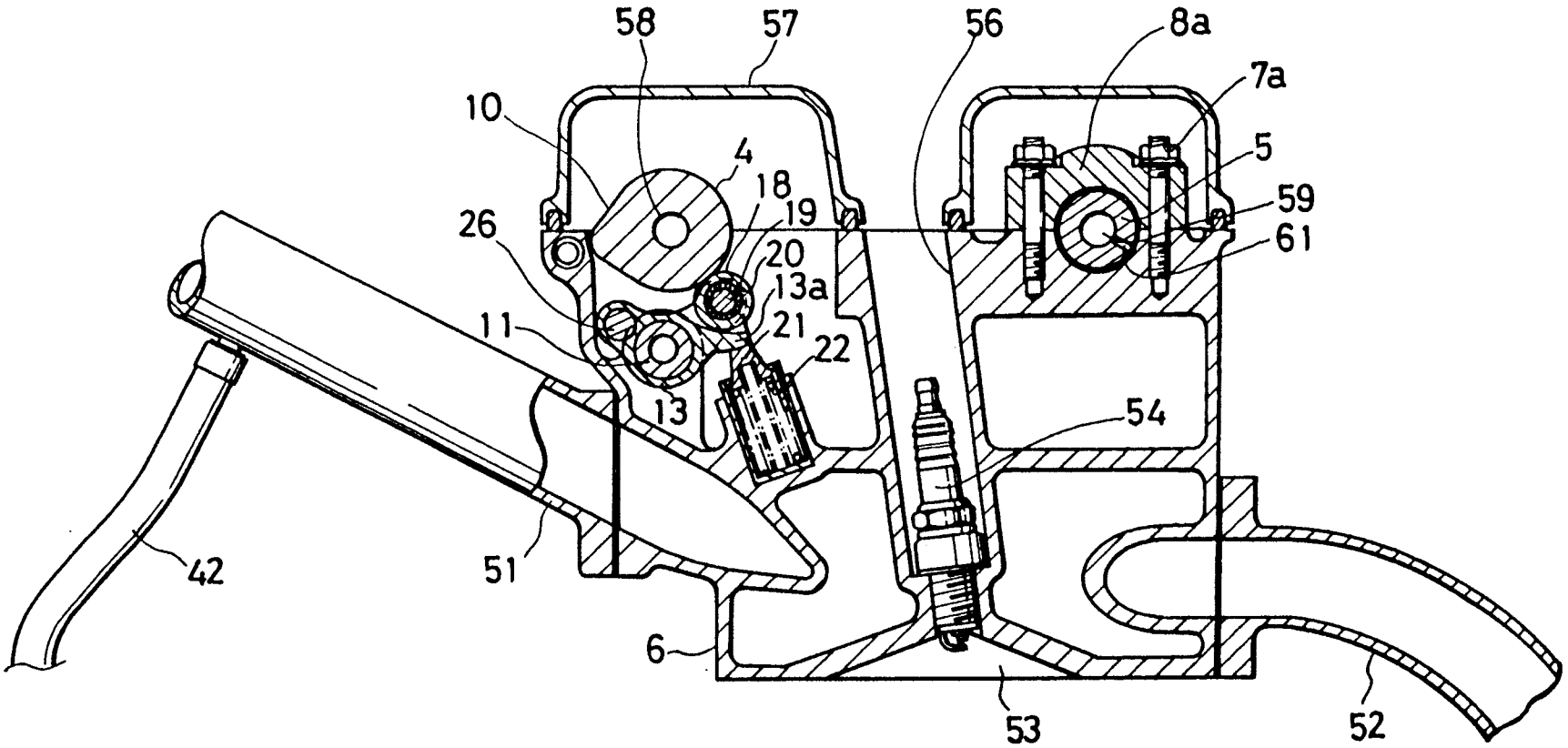
FIG. 2 is a sectional view taken along line A—A in FIG. 1.
Figure 3:
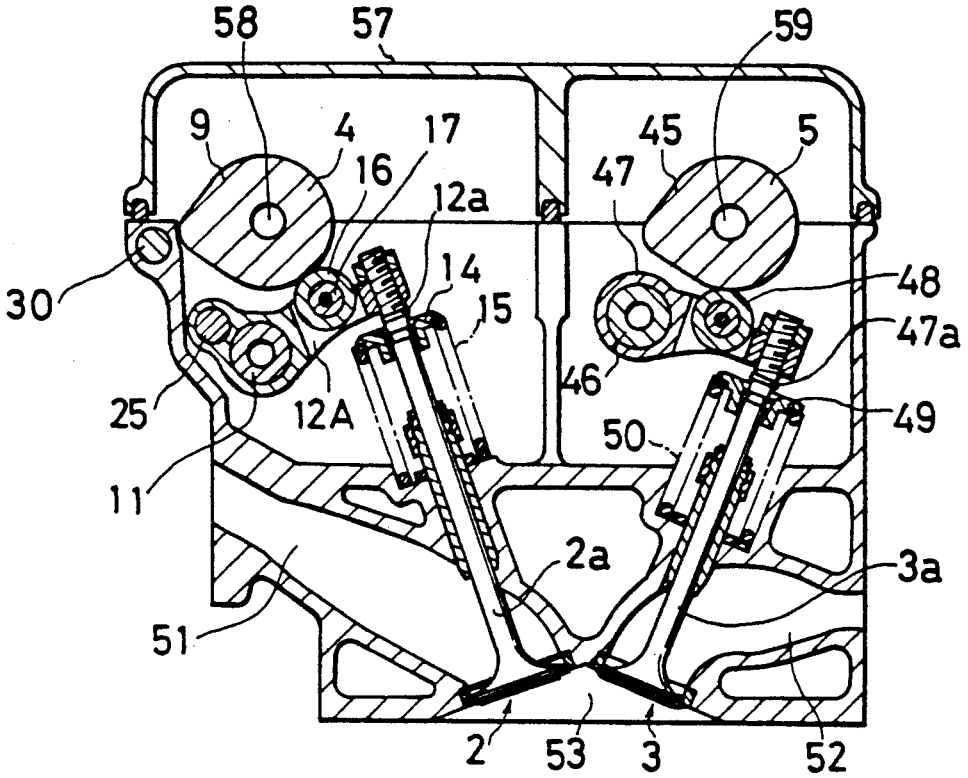
FIG. 3 is a sectional view taken along line B—B in FIG. 1.
Figure 4:
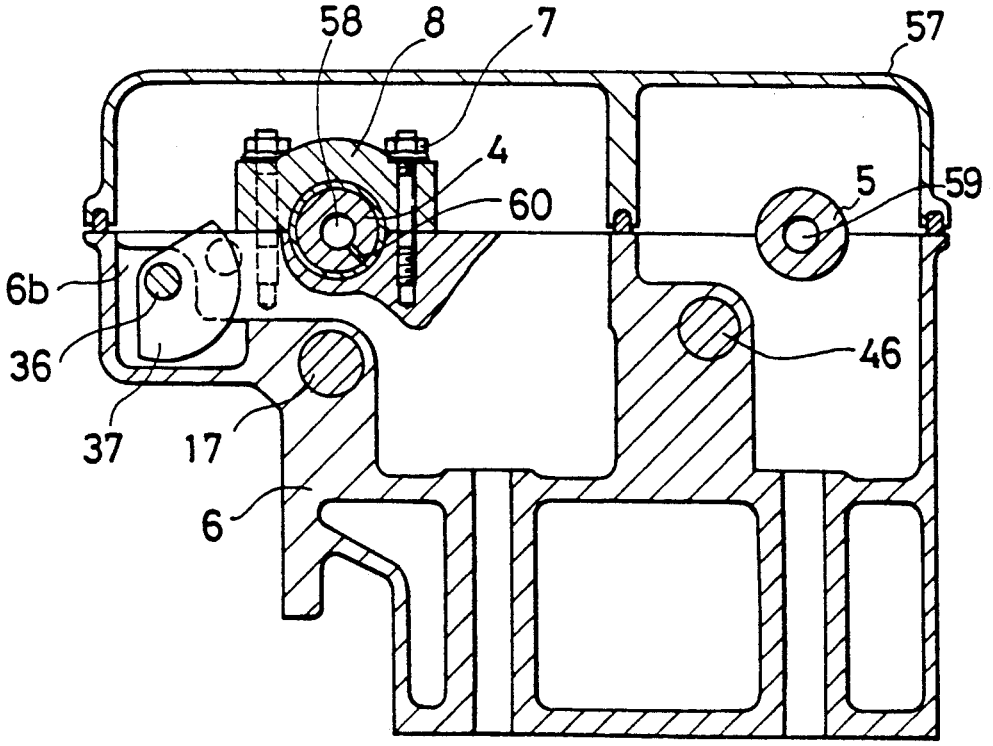
FIG. 4 is a sectional view taken along line C—C in FIG. 1.

Referring further to FIGS. 2, 3 and 4, an intake cam shaft 4 and an exhaust cam shaft 5 are disposed in a direction in which the cylinders are serially arranged. The intake cam shaft 4 is reciprocally carried by a journal portion which is formed by a concavity in the cylinder head 6 and a cam cap 8 which is fixed to the cylinder head by a bolt nut 7.

The exhaust cam shaft 5 is, in a manner identical to shaft 4, rotatably carried by a journal portion which is formed by a concavity in the cylinder head 6 and a cam cap 8*a* which is fixed to the cylinder head 6 by a bolt nut 7*a*.

On the intake cam shaft 4 are disposed a pair of first cams 9 and a second cam 10 between the first cams 9. As seen from the Figures, the width of the first cam 9 in the axial direction is smaller than that of the second cam 10.

The first cam 9 is located facing the intake valve 2 in the axial direction of the cam shaft 9. The second cam 10 is in a middle position between the two intake valves 2.

Figure 5:
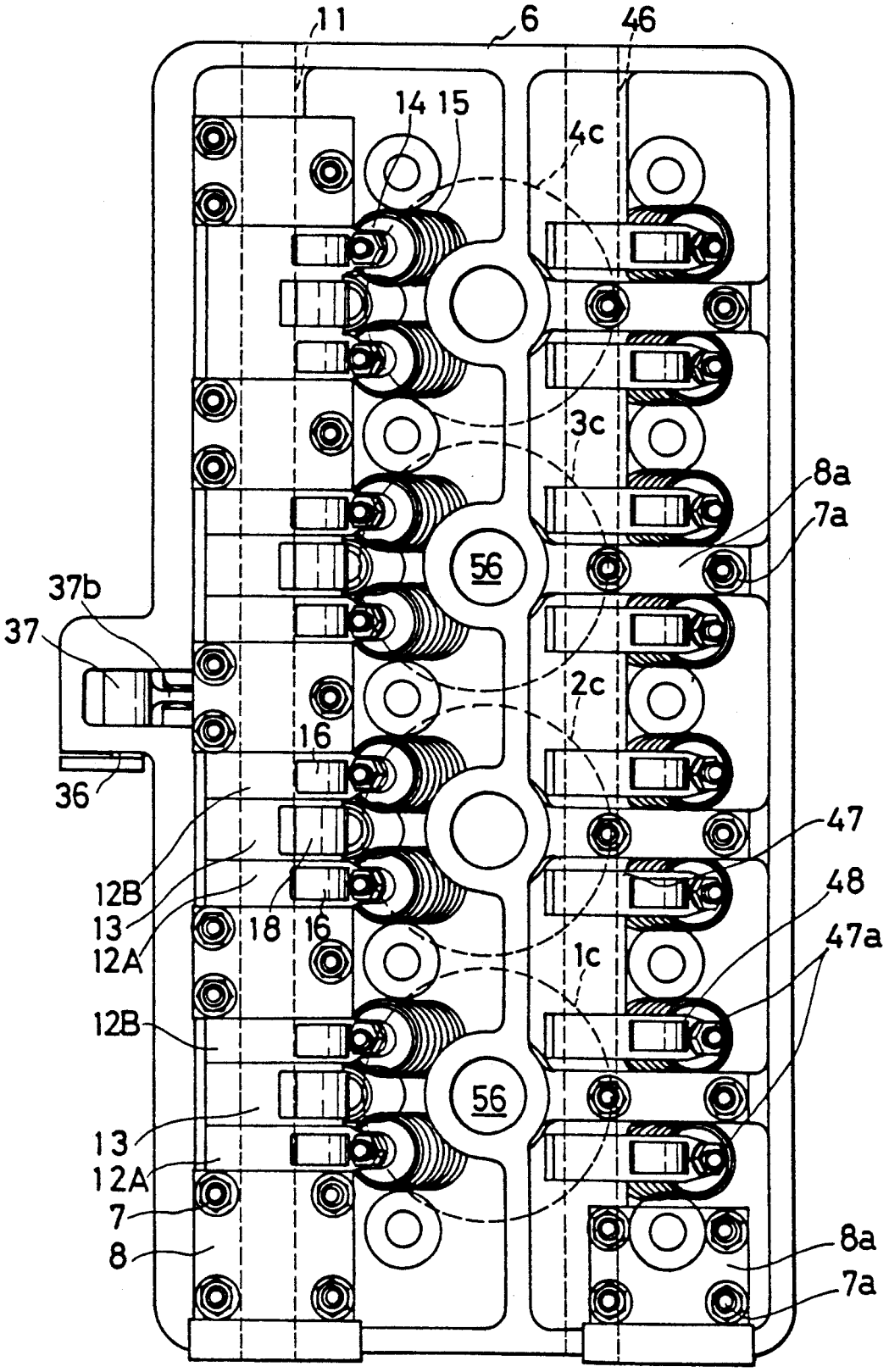
FIG. 5 is a plan view showing the structure around the rocker shaft in more detail.

Referring further to FIG. 5, the intake rocker shaft 11 extends beneath the intake cam shaft 4.

Swingably mounted on rocker shaft 11 are first rocker arms 12A and 12B, which follow first cams 9, and second rocker arms 13, which follow cams 10.

Referring to FIG. 3, each first rocker arm 12A has an engaging portion 12*a* at its front end inside the rocker shaft 11 for engaging the front end of a valve stem 2*a* of valve 2.

The intake valve 2 is biased upwardly in FIG. 3 by a valve spring 15 which is disposed between a spring stop 14 and an upper surface of the cylinder head 6 so that the tip of the valve stem 2*a* is held engaged with the engaging portion 12*a* of the rocker arm 12A.

The first rocker arm 12A is provided with a relatively light weight first roller 16 made of ceramic which is brought into rolling engagement with the first cam 9. The first roller 16 rotates about a roller shaft 17 while in rolling engagement with the first cam 9.

As shown in FIG. 2, the second rocker arm 13 is provided with a second metallic needle roller 18 which is brought into rolling engagement with the second cam 10. The second roller 18 is journaled by a number of needle bearings 20 around the roller shaft 19.

The second rocker arm 13 is formed with an engaging portion 13*a* under the second roller 18. The engaging portion 13*a* is brought into contact with an urging member 21 which is biased upwardly by a spring 22. Spring 22 is disposed so that it is compressed in a recess formed in a top portion of the cylinder head 6.

As a result, the second rocker arm 13 is kept biased upwardly by the urging member 21 as is shown in FIG. 2.

Figure 6:
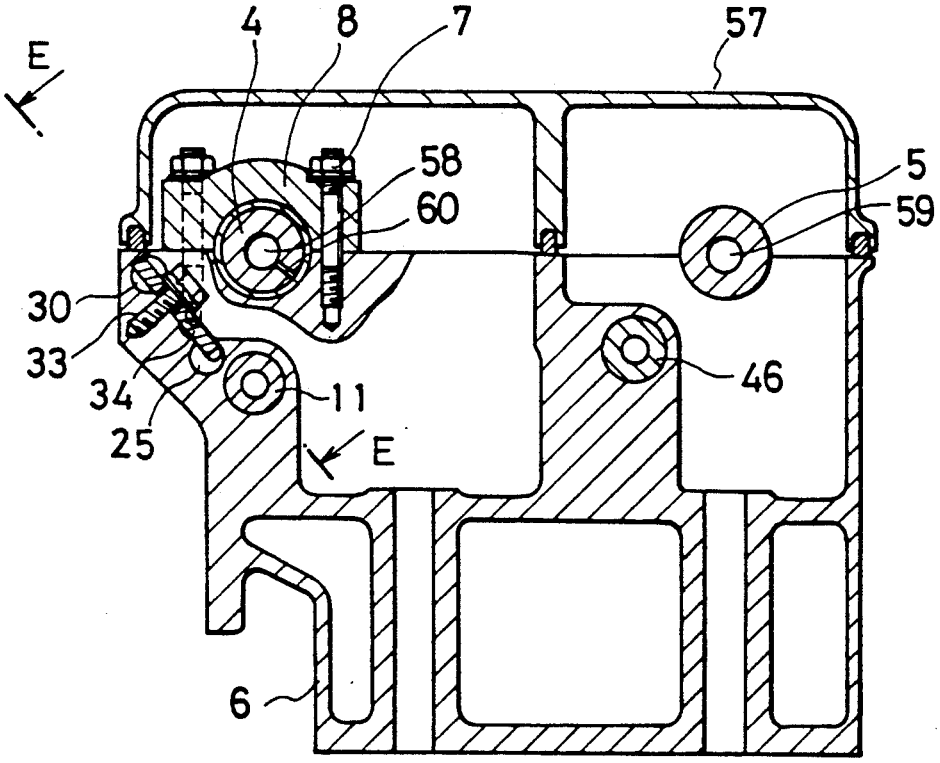
FIG. 6 is a sectional view taken along line D—D in FIG. 1.
Figure 7:
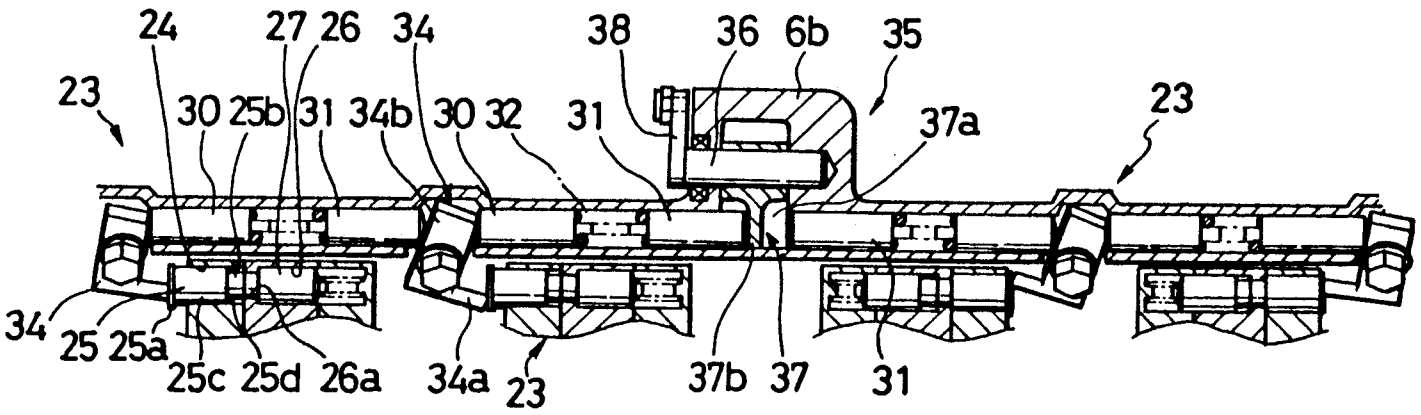
FIG. 7 is a sectional view taken along line E—E in FIG. 1.
Figure 8:
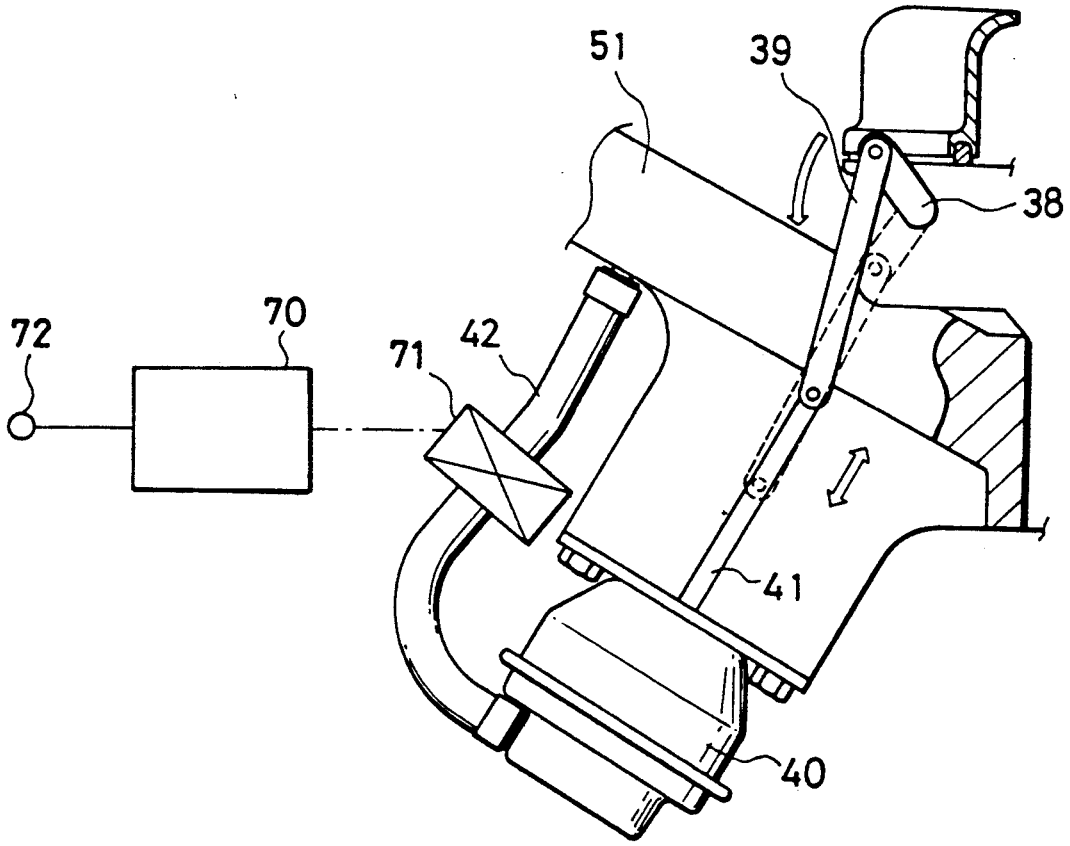
FIG. 8 is a sectional view taken along line F—F in FIG. 1.

Referring further to FIGS. 6 through 8, a switching device 23 is provided for switching whether or not the first and second rocker arms 12A, 12B and the second rocker arm 13 are moved together. The switching device 23 is provided with a first selector pin 25 which is reciprocally disposed in a through hole 24 of the rocker arm 12A, a second selector pin 27 which is reciprocally disposed in a through hole 26 of the second rocker arm 13.

FIG. 7 shows the switching devices 23 for the first and second cylinders disposed on one side of the driving mechanism 35. The switching devices 23 for the third and fourth cylinders are shown in FIG. 7, but because they are essentially symmetrically to and function identically to the devices 23 for the first and second cylinders, they are not given reference numerals and will not be discussed. The switching devices 23 are provided with a pair of first and second movable pins 30, 31 disposed in the cylinder head 6 which readily reciprocate in the direction of the cam shaft 4. A spring 32 is provided between the two pins 30, 31 to bias them away from one another. The switching device 23 is further provided with a lever 34 which is pivotally mounted on a shaft member 33.

As shown FIG. 6, the pivotal axis of the lever 34 is inclined so that the lever 34 engages with the pins 30 and 31. The tip of one L-shaped arm 34*a* of the lever 34 engages one end of the first selector pin 25. As is stated above, a switching device 23 is provided for each of the cylinders 1C, 2C, 3C and 4C.

As shown in FIG. 1, a driving mechanism 35 is provided for driving the switching mechanism 23 between the second cylinder 2C and third cylinder 3C. In this arrangement, the switching mechanisms 23 for the first and second cylinders 1C and 2C are disposed symmetrically to the switching mechanisms 23 for the third and fourth cylinders 3C and 4C and at opposite sides of the driving mechanism 35.

Thus, the switching device 23 for the first cylinder 1C is the mirror image of the device 23 for the fourth cylinder 4C.

The other arm 34*b* of the lever 34 is engaged with an end surface of the first movable pin 30 facing away from the driving mechanism 35 in the direction of the cam shaft 4.

The switching mechanism 23 for the second cylinder 2C is the mirror image of the mechanism 23 for the third cylinder 3C with respect to the driving mechanism 35. The arm 34*b* of the lever is engaged with an end surface of the first movable pin 30 facing away from the driving mechanism 35 in the direction of the cam shaft 4. The other side of the arm 34*b* is engaged with the second movable, slidable pin 31 of the device 23 for the first cylinder 1C. In other words, the other arm 34*b* is held between the first and second pins 30 and 31 in the direction of the axis of cam shaft 4.

The driving mechanism 35 is provided with a rotating shaft 36 extending parallel to the cam shaft 4. The shaft 36 is rotatably carried by a journal portion 6*b* formed on the cylinder head 6.

As shown in FIG. 4, a sector-shaped urging member 37 is fixed to the rotating shaft 36. The urging member 37 is swung in a plane perpendicular to the cam shaft 4 when the rotating shaft rotates about an axis parallel with the cam shaft 4. The urging member 37 is forcibly engaged with the ends of the second movable pins 31 of the switching devices 23 at opposite sides by virtue of resilient force of the springs 32. The urging member 37 varies in thickness as it swings.

Namely, the urging member 37 is formed with a thick portion 37*a* and thin portion 37*b* at opposite ends in the direction that the member 37 is swung. Therefore, when the urging member 37 swings, the point with the second movable pins 31 are engaged changes. As a result, when the urging member swings, the second movable pins 31 for the second and third cylinders of the switching device 23 are displaced in the axial direction of the cam shaft.

For example, the axial movement of the pins 31 of the switching device 23 for the second cylinder 2C is transmitted to the lever 34 for the second cylinder 2C by means of the spring 32 and the first movable pin 30 of the switching device 23 for the second cylinder 2C. The axial movement is further transmitted to the lever 34 for the first cylinder 1C by means of the lever 34 for the second cylinder 2C, the second movable pin 31 and the spring 32 and the first movable pin 30 of the switching device 23 for the first cylinder 1C. In a symmetrical manner, this axial movement of the pins 31 is transmitted to a corresponding switching devices 23 of cylinders 3C and 4C. Although the pin 31 of the switching device 23 of the cylinder 3C is shown not to contact portion 37*b* in FIG. 7, in actuality it would. In FIG. 7, the devices 23 for the cylinders 3C and 4C are in a position they would assume if pin 31 of cylinder 3C were contacting thick portion 37*a*. Thus, FIG. 7 shows pins 31 for the cylinders 1C and 2C in an undisplaced configuration and the pins 31 for cylinders 3C and 4C in a displaced configuration.

As mentioned above, when the swinging movement of the urging member 37 of the driving mechanism 35 is transmitted to the lever 34 of the switching device 23, the first selector pin 25 engaged with the tip of arm 34*a* is moved in the axial direction of the cam shaft 4 to engage and disengage the first and second rocker arms 12A, 12B and 13.

Figure 9A:
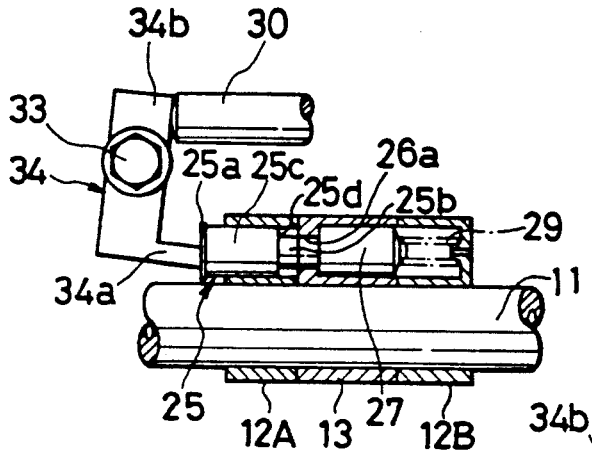
FIGS. 9A, and 9B are partially sectional views showing operation of a switching device according to the present invention.

Referring to FIG. 9A, the first selector pin 25, the second selector pin 27 and spring 29 are all disposed within the first rocker arm 12A, the second rocker arm 13 and the first rocker arm 12B respectively. The arrangement in this Figure shows the disengagement of the first and second rocker arms 12A, 12B and 13. In this arrangement, a flange portion 25*a* formed on the one end of the first selector pin 25 (shown in the Figure to be engaged with the one arm 34*a* of the lever 34) is spaced leftward from entrance of the hole 24 of the first rocker arm 12A. The first selector pin 25 is formed with a small diameter portion 25*b* formed on the side opposite to the flange portion 25*a*. A large diameter portion 25*c* is formed between the flange portion 25*a* and the small portion 25*b*. A stepped portion 25*d* is formed between the large and small portions 25*b* and 25*c*. In the arrangement shown in FIG. 9A, the small portion 25*b* is outside of a reduced diameter portion 26*a* of the hole 26 and the stepped portion 25*d* is spaced from the entrance of the hole 26 of the rocker arm 13.

Figure 9B:
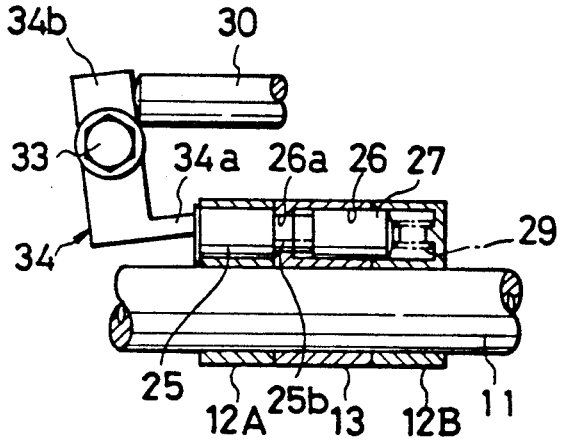

In the arrangement shown in FIG. 9B, the lever 34 is rotated from the position of FIG. 9A in the counterclockwise direction, thereby compressing the spring 29 so that the flange portion 25*a* of the first selector pin 25 is engaged with the first rocker arm 12A and flush with the hole 24 of the arm 12A. The small portion 25*b* enters into the reduced portion 26*a* of the hole 26 in the second rocker arm 13 so that the stepped portion 25*d* is flush with the entrance of the hole 26. In this arrangement, the first rocker arms 12A, 12B are swung together with the second rocker arm 13.

For facilitating understanding of the present invention, in the arrangement shown in FIG. 7, the first and second rocker arms 12A, 12B and 13 for the first and second cylinders 1C and 2C are in the disengaged condition. On the other hand, the rocker arms 12A, 12B and 13 for the third and fourth cylinders 3C and 4C are in the engaged condition. This is done only to illustrate the two positions in one Figure. The engagement and disengagement of the rocker arms is commonly done simultaneously for all four cylinders.

The second cam 10 has a larger cam profile than that of the first cam 9. Therefore, when the first and second rocker arms 12A, 12B and 13 are engaged, the valve opening characteristic or parameter of the intake valve 2 is dominated by the cam profile of the second cam 10 and not influenced by the cam profile of the first cam 9. That is, the valve opening characteristic is determined by the cam profile of the second cam 10.

When the first and second rocker arms 12A, 12B and 13 are disengaged, the first rocker arms 12A and 12B are swung independently from the second rocker arm 13 in accordance with the cam profile of the first cam 9. In this case, the intake valve 2 is not influenced by the cam profile of the second cam 10. As a result, the second rocker arm 13 is swung freely, unrelated to the opening and closing of the valve 2, while engaged with the urging member 21.

As shown in FIG. 8, lever 38 is mounted on one end of the rotating shaft 36 of the driving mechanism 35. The lever 38 is connected with a drive rod 41 of an actuator 40 through a link 39. The actuator 40 is provided with a diaphragm mechanism (not shown). A negative pressure formed in a intake gas passage downstream of a throttle valve is introduced into a pressure chamber of the diaphragm mechanism through a communicating passage 42. A solenoid valve 71 controlled by a control unit 70 receiving a signal from engine speed sensor 72 is provided on the passage 42. The solenoid valve is opened at an engine speed greater than a predetermined value N1. When the negative pressure is introduced into the pressure chamber of the diaphragm mechanism, the drive rod 41 is displaced in its axial direction. As a result, the lever 38 rotates the rotating shaft 36 of the drive mechanism 35 which in turn makes the urging member 37 swing.

As the engine load is increased and thus the negative pressure is reduced, the urging force by the diaphragm mechanism is reduced so that the drive rod 41 is returned by the resilient force of a spring.

The release of the negative pressure can be made by a solenoid (not shown) for controlling communication of the pressure chamber with the atmosphere. In this case, when the solenoid is actuated, the pressure chamber is communicated with the atmosphere so that the negative pressure is eliminated and the lever 41 is returned by virtue of the spring.

Referring to FIG. 3, the exhaust cam shaft 5 is provided with a pair of cams 45 (only one is shown in the Figure). The rocker shaft 46 is disposed under the exhaust cam shaft 5 and is carried by the cylinder head 6. On the rocker shaft 46, a rocker arm 47 is mounted engaged with the cam 45. The rocker arm 47 is provided with an engaging portion 47*a* engaged with a tip of a valve stem 3*a* of the exhaust valve 3 and a roller 48 which is brought into a rolling engagement with the surface of the cam 45. The roller 48 has the same structure and is made of the same material as the second roller 18.

A retainer 49 and a valve spring is engaged with the exhaust valve 3 so that the valve stem 3*a* is forcibly biased against the rocker arm 47 by a resilient force. As a result, the roller 48 is kept engaged with the surface of the cam 45.

The valve opening characteristic depends on the cam profile of the cam 45.

As shown in FIGS. 2 and 3, the cylinder head 6 is formed with intake and exhaust passages 51 and 52 which respectively communicate with a combustion chamber 53 by means of the intake valve 2 and the exhaust valve 3.

As shown in FIGS. 1 and 2, an ignition plug 54 is mounted on the cylinder head 6 in an ignition hole 56 so that the tip of the spark plug 54 projects into the combustion chamber 53.

Referring to FIG. 2, a cylinder head cover 57 is mounted on the cylinder head 6 to cover the valve operating mechanism.

A lubricating system is provided for the valve operating system. The lubricating system is provided with oil passages 58 and 59 formed in the cam shafts 4 and 5 and extending along the center axis thereof. As shown in FIGS. 2 and 4, there are radial oil passages 60 and 61 extending radially from the oil passages 58 and 59 to the surface of the journal portions of the cam shaft 4 and 5 for lubricating the journal portions. According to the illustrated structure, the rocker shafts 11 and 46 are disposed under the cam shafts 4 and 5 so that lubricating fluid from the journal portions of the cam shafts 4 and 5 is naturally and downwardly introduced for lubricating the engaging portion of the rocker shafts 11 and 46 and rocker arms 12, 13.

In operation, when the engine is started, the intake gas begins to be introduced.

When the engine load is low, a relatively large negative pressure is produced in the intake passage. The large negative pressure moves the drive rod 41 leftward and downward in FIG. 8 so that the lever 38 is rotated counterclockwise to be in the position shown by a broken line in FIG. 8.

As a result, the rotating shaft 36 is rotated counterclockwise so that the sector-shaped urging member 37 is swung in a direction perpendicular to the axial direction of the cam shaft 4. Thus, the second movable pin 31 is moved from a position where the end of the pin 31 is engaged with the thin portion 37*b* to a position where the end of the pin 31 is engaged with the thick portion 37*a*. In this case, the movable pin 31 changes position with the urging member 37, in other words, it moves on a continuously graded surface formed on the urging member 37 from the thin portion 37*b* to the thick portion 37*a*. When the pin 31 reaches the thick portion 37*b*, the second movable pin 31 is moved in the axial direction of the cam shaft 4 to establish the engaged condition as shown in FIG. 9B.

In the engaged condition where the first rocker arms 12A, 12B and the second rocker arm 13 swing together, the valve opening characteristic depends on the second cam 10 and the cam profile of the first cam 9 does not influence the actual valve opening characteristic of the intake valve 2.

Figure 10:
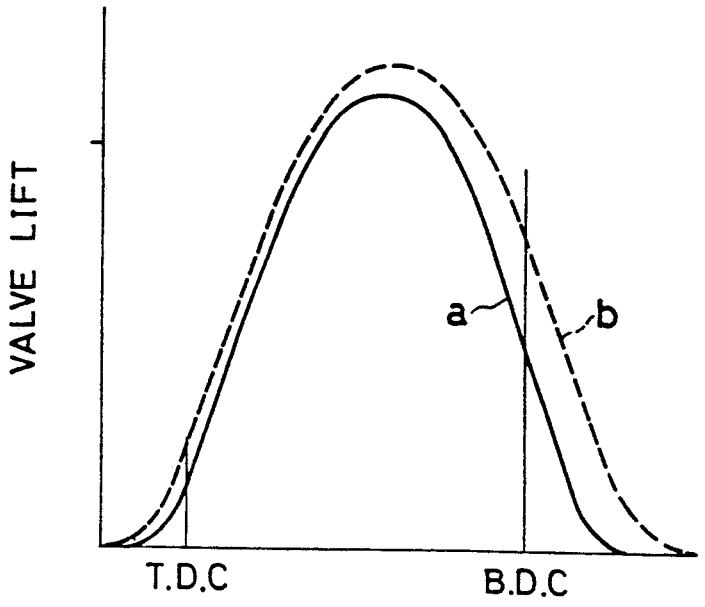
FIG. 10 is a graphical representation showing a valve opening characteristic.

In FIG. 10, the unbroken line a shows a valve opening characteristic of a conventional engine in a low engine load.

The valve opening characteristic according to the present invention is shown by a broken line b which is defined by the cam profile of the second cam 10. Comparing the line a with the line b, the valve opening characteristic of the line b is larger in both the open period and valve lift than that of the line a. In the characteristic of line a, the valve is closed just after the bottom dead center (B.D.C.) of the piston in the intake stroke. (In the Figure, T.D.C. refers to the top dead center position of the valve.) In the characteristic of line b, the valve is closed later than line a.

Figure 11:
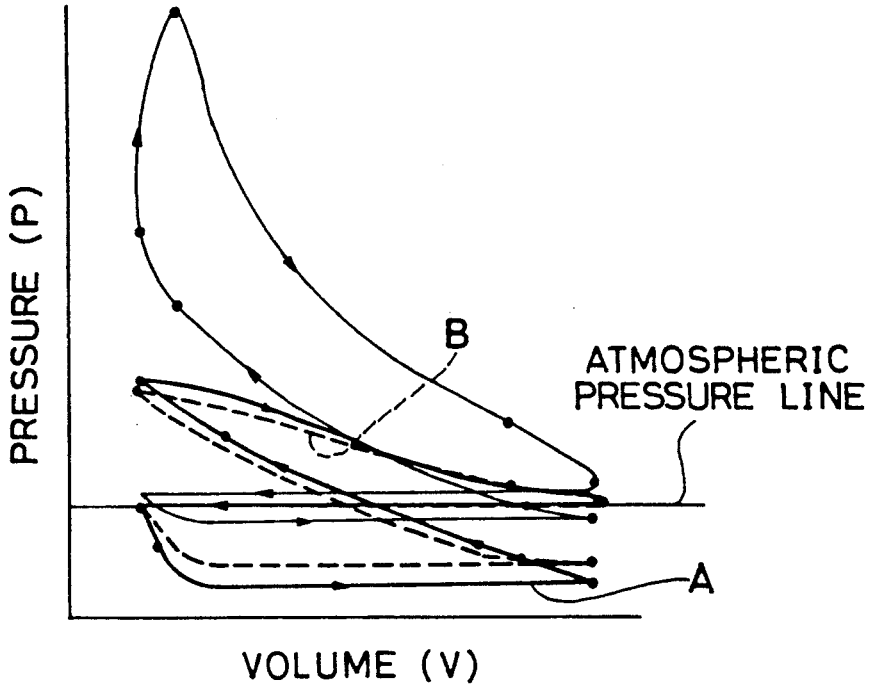
FIG. 11 is a graphical representation showing a P-V chart for an engine incorporating the present invention.

As a result, as shown in the P-V (pressure-volume) chart shown in FIG. 11, when the engine is operated in accordance with the valve opening characteristic of the line a in FIG. 10, the P-V property of the engine obtained can be shown by a line A. On the other hand, when the engine is operated in accordance with the line b of FIG. 10, the P-V property obtained is shown by a line B. Comparing the line A with the line B in FIG. 11, it will be understood that pumping loss of the engine is reduced under the line B. Therefore, if the valve is operated in accordance with the line b, the fuel consumption efficiency can be improved, particularly in the low engine load operating condition in which the larger negative pressure is produced because of the smaller opening of the throttle valve. As the engine load is increased, the negative pressure is reduced so that the pumping loss is also obviated. Thus, the fuel consumption efficiency can be improved greatly in the low engine load condition.

Furthermore, as shown in the valve opening characteristic in FIG. 10, in the high engine load and high engine speed condition, the line a is produced as a result of the first and second rocker arms 12A, 12B and 13 being disengaged. Thus, the valve lift is reduced and bouncing at the time of closing the intake valve can be obviated. Therefore, the rotational speed limit of the engine can be enhanced.

Figure 12:
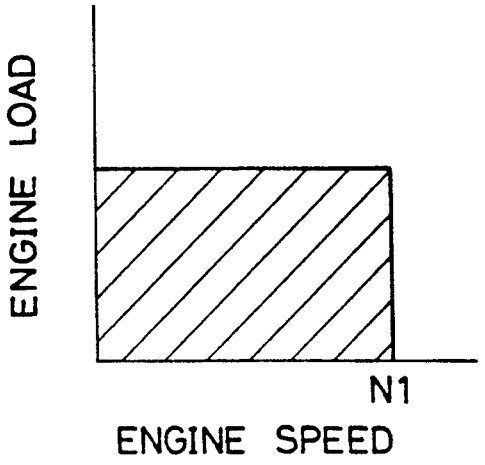
FIG. 12 is a graphical representation showing the relationship between the engine load and engine speed in an engine incorporating the present invention.

The first and second rocker arms 12A, 12B and 13 are swung together in a hatched area shown in FIG. 12. Typically, the engaged condition is established when the engine is idling.

Then, as the engine load is increased, the throttle opening is increased but the negative pressure of the intake passage is reduced. As a result, the drive rod 41 is returned toward the position shown by solid line drawing in FIG. 8. This movement makes the engaging point between the second movable pin 31 for the second and third cylinders 2C and 3C move the from the thick portion 37*a* to the thin portion 37*b* to establish the disengaged condition of the rocker arms 12A, 12B and 13 as shown in FIG. 9A. In the disengaged condition, the second rocker arm 13 does not influence the operation of the intake valve 2. In this case, the intake valve 2 is operated in accordance with the valve opening characteristic defined by the first cam 9.

Although the above explanation is made using an embodiment in which the present invention is applied to the intake valve operating system, the present invention can be also effectively applied to the exhaust valve operating system. When the present invention is applied to the exhaust valve operating system, the overlapping period in the valve opening is increased so that the residual uncombusted constituent is increased in the intake gas. As a result, the combustion efficiency can be improved. In this embodiment, it is preferred that the switching device 23 be controlled electrically by a solenoid. The engine load can be detected by a conventional electric device which can be employed for controlling the solenoid.

Alternatively, the valve operating system according to the present invention can be applied to both the intake and exhaust system.

While the present invention has been illustrated in terms of several preferred embodiments, one of ordinary skill in the art will recognize that modifications and improvements can be made while remaining within the scope and spirit of the present invention. The scope of the invention is determined solely by the appended claims.

What is claimed is:

1. A valve operating system for operating a valve in an engine, comprising:

a cam shaft;

first and second cams mounted on the cam shaft;

a first rocker arm adapted to follow the first cam and engage a valve stem of the valve to operate the valve;

a second rocker arm adapted to follow the second cam;

connecting means for selectively connecting the first and second rocker arms, so that the rocker arms move together and together follow the second cam, and disconnecting the first and second rocker arms, so that the first rocker arm moves independently of the second rocker arm;

engine load detecting means for detecting a load on said engine; and control means for controlling the connecting means to selectively connect the first and second rocker arms when a load smaller than a predetermined value is detected by the engine load detecting means so that a valve opening characteristic is defined by a cam profile of the second cam and otherwise disconnect the first and second rocker arms so that the valve opening characteristic is defined by a cam profile of the first cam, wherein a cam profile of the first cam is not greater than that of the second cam throughout valve opening so that an opening period of the valve is increased and a closing timing of the valve is delayed when the connecting means connects the first and second rocker arms together.

2. A valve operating system as recited in claim 1, wherein the profile of the first cam is smaller than the profile of the second cam.

3. A valve operating system as recited in claim 1, wherein the valve is an intake valve.

4. A valve operating system as recited in claim 1, wherein the valve is an exhaust valve.

5. A valve operating system as recited in claim 1 further comprising a rocker shaft for swingingly carrying the first and second rocker arms.

6. A valve operating system for operating a valve in an engine, comprising:

a cam shaft;

first and second cams mounted on the cam shaft;

a first rocker arm adapted to follow the first cam and engage a valve stem of the valve to operate the valve;

a second rocker arm adapted to follow the second cam;

connecting means for selectively connecting the first and second rocker arms, so that the rocker arms move together and together follow the second cam;

control means for controlling the connecting means to selectively connect the first and second rocker arms in accordance with a vehicle operating condition so that a valve opening characteristic is defined by a cam profile of the second cam; and a rocker shaft for swingingly carrying the first and second rocker arms;

wherein the connecting means comprises a movable pin adapted to reciprocate in the direction of an axis of one of the rocker shafts between a first position in which the first and second rocker arms are engaged to be swung together, and a second position, in which the first rocker arm is disengaged from the second arm to swing independently, and a lever engaging the pin to reciprocate the movable pin between the first and second positions.

7. A valve operating system as recited in claim 6, wherein the control means comprises an actuator for controlling the movement of the lever.

8. A valve operating system as recited in claim 7, wherein the actuator causes the lever to move the pin to the first position when the actuator is actuated by the introduction of a negative pressure from an intake gas.

9. A valve operating system as recited in claim 8, wherein, when the negative pressure is no longer introduced, the actuator causes the lever to move the movable pin to the second position.

10. A valve operating system for operating a valve in an engine having multiple cylinders, comprising:

a cam shaft;

first and second cams mounted on the cam shaft, wherein said second cam has a larger profile than said first cam;

a first rocker arm adapted to follow the first cam and engaging a valve stem of a valve to operate the valve;

a second rocker arm adapted to follow the second cam;

a first light-weight roller rotatably disposed on the first rocker and adapted to be brought into rolling engagement with the first cam;

a second roller rotatably disposed on the second rocker arm and in rolling engagement with the second cam;

connecting means for selectively connecting the first and second rocker arms, so that the rocker arms move together and together follow the second cam, and disconnecting the first and second rocker arms, so that the first rocker arm moves independently of the second rocker arm;

engine load detecting means for detecting a load on said engine; and control means for controlling the connecting means to selectively connect the first and second rocker arms when a load smaller than a predetermined value is detected by the engine load detecting means so that a valve opening characteristic is defined by a cam profile of the second cam and otherwise disconnect the first and second rocker arms so that the valve opening characteristic is defined by a cam profile on the first cam.

11. A valve operating system as recited in claim 10 further comprising an operation controller for controlling a valve opening characteristic by switching between a first mode of operation when the engine is in a low speed operating condition, and a second mode when the engine is in a high speed operating condition, wherein in the first mode the first and second rocker arms are engaged to be swung together so that the valve opening characteristic is defined by a cam profile of the second arm, and wherein in the second mode the first and second rocker arms are disengaged from each other so that the valve opening characteristic is defined by a cam profile of the first cam.

12. A valve operating system as recited in claim 10, wherein the first roller is made from a ceramic and the second roller is made from a steel.

13. A valve operating system for operating a valve in an engine, comprising:

a cam shaft;

first and second cams mounted on the cam shaft;

a first rocker arm adapted to follow the first cam and engaging a valve stem of a valve to operate the valve;

a second rocker arm adapted to follow the second cam at a position not interfering with the valve stem, a selector pin movably disposed in one of the rocker arms and adapted to move between first and second positions, wherein in the first position the pin causes the first and second rocker arms to be engaged and to be swung together, and wherein in the second position the first rocker arm is disengaged from the second rocker arm and the arms swing independently, a lever operably connected to the selector pin, a movable pin which is movable in an axial direction of a shaft of one of the rocker arms by the lever, wherein when the selector pin is in the first position the movable pin engages the first and second rocker arms to cause them to be swung together and when the selector pin is in the second position the movable pin is disengaged from the second arm so that the arms are swung independently, the lever having a pivoting axis and a pair of arms extending opposite directions with regard to the pivoting axis, wherein one of the arms engages one end of the selector pin and the other of the arms engages the movable pin.

14. A valve operating system as recited in claim 13 further comprising drive means for driving the selector pin in accordance with an operating condition of the engine.

15. A valve operating system as recited in claim 14 wherein the drive means is disposed between two cylinder of the engine which do not follow in combustion order.

16. A valve operating system as recited in claim 14 wherein the movable pin is mounted on a cylinder head of the engine.

17. A valve operating system as recited in claim 14 wherein the drive means is provided on one side of the cylinder head.

18. A valve operating system as recited in claim 14 wherein the engine has a plurality of cylinders and a selector pin, lever and movable pin are provided for each of the cylinders.

19. An engine having a cylinder including a combustion chamber, a valve communicating with the combustion chamber of the cylinder, and a switching mechanism, wherein the switching mechanism comprises:

a cam shaft;

first and second cams mounted on the cam shaft;

a first rocker arm adapted to follow the first cam and engaging a valve stem of a valve to operate the valve;

a second rocker arm following the second cam;

connecting means for selectively connecting the first and second rocker arms, so that the rocker arms move together and together follow the second cam, and disconnecting the first and second rocker arms, so that the first rocker arm moves independently of the second rocker arm;

engine load detecting means for detecting a load on said engine; and control means for controlling the connecting means to selectively connect the first and second rocker arms when a load smaller than a predetermined value is detected by the engine load detecting means so that a valve opening characteristic is defined by a cam profile of the second cam and otherwise disconnect the first and second rocker arms so that the valve opening characteristic is defined by a cam profile of the first cam, wherein a cam profile of the first cam is not greater than that of the second cam throughout valve opening so that an opening period of the valve is increased and a closing timing of the valve is delayed when the connecting means connects the first and second rocker arms together.

20. An engine as recited in claim 19, and further comprising four cylinders in a straight configuration wherein each of the cylinders comprises a valve, first and second cams, first and second rocker arms, and connecting means.

21. An engine as recited in claim 19, and further comprising a second valve communicating with the combustion chamber, and a second switching mechanism comprising:

a second cam shaft;

third and fourth cams mounted on the second cam shaft;

a third rocker arm adapted to follow the third cam and engaging a valve stem of the second valve to operate the second valve, a fourth rocker arm following the fourth cam;

second connecting means for selectively connecting the third and fourth rocker arms, so that the rocker arms move together and together follow the fourth cam, and disconnecting the first and second rocker arms, so that the first rocker arms moves independently of the second rocker arm; and control means for controlling the second connecting means to selectively connect the third and fourth rocker arms in accordance with a second vehicle operating condition, so that a second valve opening characteristic is defined by a cam profile of the fourth cam and disconnect the first and second rocker arms in accordance with the vehicle operating condition, so that the valve opening characteristic is defined by a cam profile of the first cam, wherein a cam profile of the first cam is not greater than that of the second cam throughout valve opening so that an opening period of the valve is increased and a closing timing of the valve is delayed when the connecting means connects the first and second rocker arms together.

22. An engine as recited in claim 21, wherein the first valve is an intake valve and the second valve is an exhaust valve.

23. An engine as recited in claim 19, wherein the valve is an intake valve.

24. An engine as recited in claim 19, wherein the valve is an exhaust valve.

25. A valve operating system for operating a valve in an engine, comprising:

a cam shaft;

first and second cams mounted on the cam shaft;

a first rocker arm adapted to follow the first cam and engage a valve stem of the valve to operate the valve;

a second rocker arm adapted to follow the second cam;

engine speed detecting means for detecting engine speed; and connecting means for selectively connecting the first and second rocker arms, so that the rocker arms move together and follow the second cam, and disconnecting the first and second rocker arms, so that the first rocker arm moves independently of the second rocker arm, said connecting means selectively connecting and disconnecting the first and second rocker arms in accordance with an engine speed detected by the engine speed detecting means such that when the engine speed is lower than a predetermined value, the first and second rocker arms are connected so that a valve opening characteristic is defined by a cam profile of the second cam, the first and second rocker arms otherwise being disconnected so that the valve operating characteristic is defined by a cam profile of the first cam, wherein a cam profile of the first cam is not greater than that of the second cam throughout valve opening so that an opening period of the valve is increased and a closing timing of the valve is delayed when the connecting means connects the first and second rocker arms together.

26. A valve operating system as defined by claim 25, and further comprising engine load detecting means for detecting a load on said engine and control means for controlling the connecting means to selectively connect the first and second rocker arms when a load smaller than a predetermined value is detected by the engine load detecting means so that a valve opening characteristic is defined by a cam profile of the second cam and otherwise disconnect the first and second rocker arms so that the valve opening characteristic is defined by a cam profile of the first cam.

* * * * *